US005834148A

United States Patent [19]

Murayama et al.

[11] Patent Number: 5,834,148

[45] Date of Patent: Nov. 10, 1998

[54] ELECTRICALLY-CONDUCTIVE SUBSTRATE FOR ELECTROPHOTOGRAPHIC PHOTORECEPTOR, ELECTROPHOTOGRAPHIC PHOTORECEPTOR COMPRISING SAME AND PROCESS FOR THE PREPARATION THEREOF

[75] Inventors: Masakatsu Murayama; Susumu Taguchi; Toshiyuki Araki, all of Kanagawa, Japan

[73] Assignee: Mitsubishi Chemical Corporation, Tokyo, Japan

[21] Appl. No.: 833,775

[22] Filed: Apr. 9, 1997

[30] Foreign Application Priority Data

Apr. 9, 1996 [JP] Japan ..... 8-086445

[51] Int. Cl.[6] ..... G03G 58/10

[52] U.S. Cl. ..... 430/69; 430/127; 420/528

[58] Field of Search ..... 430/69, 127; 420/528

[56] References Cited

U.S. PATENT DOCUMENTS

| | | | |
|---|---|---|---|
| 4,500,622 | 2/1985 | Horie et al. | 430/83 |
| 4,866,479 | 9/1989 | Tsukuda et al. | 430/69 |
| 4,897,329 | 1/1990 | Nakayama | 430/49 |
| 4,910,109 | 3/1990 | Yokoya et al. | 430/49 |

FOREIGN PATENT DOCUMENTS

| | | | |
|---|---|---|---|
| 3930045 | 3/1990 | Germany | 430/127 |
| 55-7776 | 1/1980 | Japan | 430/127 |
| 63-261367 | 10/1988 | Japan | 430/69 |

*Primary Examiner*—Roland Martin

*Attorney, Agent, or Firm*—Oblon, Spivak, McClelland, Maier & Neustadt, P.C.

[57] ABSTRACT

The present invention prevents the deterioration of electrophotographic photoreceptor properties due to non-uniform dissolution of the surface of an aluminum substrate or production of hydrates during rinsing or drying from hot pure water in an aqueous cleaning process, assuring the uniformity and stability on the surface of an electrically-conductive substrate for electrophotographic photoreceptor. The resulting electrically-conductive substrate for electrophotographic photoreceptor exhibits an excellent corrosion resistance that can be expected to provide a high environmental stability. Further, the resulting electrophotographic photoreceptor can exhibit improved electrical properties. The present invention provides a novel electrically-conductive substrate for electrophotographic photoreceptor comprising aluminum or aluminum alloy, wherein the element ratio of aluminum in metallic form to aluminum in oxide form on the surface of said substrate as determined by X-ray photoelectron spectroscopy is 1:1 to 1:2.5 and the element ratio of aluminum to phosphorus on the surface of said substrate as determined by X-ray photoelectron spectroscopy is 1:0.02 to 1:0.1.

6 Claims, 4 Drawing Sheets

ELECTRICALLY-CONDUCTIVE SUBSTRATE FOR ELECTROPHOTOGRAPHIC PHOTORECEPTOR, ELECTROPHOTOGRAPHIC PHOTORECEPTOR COMPRISING SAME AND PROCESS FOR THE PREPARATION THEREOF

FIELD OF THE INVENTION

The present invention relates to an electrically-conductive substrate for electrophotographic photoreceptor comprising aluminum or aluminum alloy, an electrophotographic photoreceptor and a process for the preparation of such an electrophotographic photoreceptor.

BACKGROUND OF THE INVENTION

In general, an electrophotographic photoreceptor comprises a cylindrical or other shape electrically-conductive substrate and a photoconductive layer formed on the substrate. Examples of the material for the cylindrical substrate include aluminum, iron, stainless steel, copper, zinc, nickel, and electrically-conducted plastic and glass. Among these materials, aluminum or aluminum alloy, which is relatively inexpensive, has a light weight, exhibits a good workability and does not impair electrical properties, has been widely used.

In general, if aluminum is used to form a cylindrical substrate, aluminum billet is processed by port-hole method, mandrel forming method or the like into an extruded tube which may then be subjected to pultrusion, impact molding, ironing or planishing by diamond turning to have a predetermined thickness and external diameter. Further, the substrate material may be optionally subjected to anodization to prevent image defects such as "background noise" which appears as dirty background on the print. Since the substrate has drawing oil, cutting oil, corrosion-preventing oil, various dust from the air, etc. attached to its surface, it cannot form a uniform photosensitive layer. Thus, it is an ordinary practice to thoroughly clean the surface of the substrate to remove these impurities before the formation of the photoconductive layer.

In order to clean the substrate, chlorine-based solvents such as trichloroethylene and 1,1,1-trichloroethane, fluorine-based solvents such as freon 113, petroleum hydrocarbon-based solvents or mixture thereof have heretofore been used. Immersion cleaning optionally under the action of ultrasonic wave, scrubbing with a brush, sponge or the like, jet cleaning and vapor degreasing may be effected singly or in combination.

These organic solvents have a high cleaning performance. In particular, chlorine-based solvents and fluorine-based solvents are advantageous in that they are non-combustible. Thus, these solvents have been often used. However, problems of environmental pollution by chlorine-based solvents and destruction of the ozone layer by fluorine-based solvents have recently been revealed. Accordingly, substitute cleaning fluids for these organic solvents and substitute cleaning methods have been keenly desired, and it has been desired to employ an aqueous cleaning method causing less environmental problems.

With respect to the aqueous cleaning methods, a cleaning method using a cleaning fluid containing a surfactant has drawn the attention. Representative examples of such a cleaning agent include alkaline detergents and neutral detergents. If the object for cleaning is a metal such as aluminum, the alkaline detergents, despite their high cleaning performance, cause non-uniform etching to result in unevenness or can possibly cause corrosion problem due to the residual cleaning components depending on the conditions of the subsequent treatments such as rinsing and drying. Even the use of the neutral detergents often causes problems in etching or corrosion. The electrophotographic photoreceptor prepared from the electrically-conductive substrate which has been cleaned with such a detergent can cause defects such as black spots, white spots and unevenness on the copied image.

In order to solve these problems, JP-A-7-219244 (The term "JP-A" as used herein means an "unexamined published Japanese patent application") proposes to use a cleaning fluid containing N-methyl-2-pyrrolidone and water in order to effectively remove stain from the surface of an aluminum substrate and hence clean the surface of the aluminum substrate without non-uniform corrosion.

JP-A-7-258605 proposes to use a cleaning fluid containing 1,2-butanediol and water, which can exert the same effects as in JP-A-7-219244.

In general, the foregoing cleaning treatment is followed by rinsing with water to remove the cleaning fluid remaining on the surface of the substrate. Subsequently, the substrate is dipped in pure water which has been heated to a temperature of from about 50° C. to 95° C. for a predetermined period of time, pulling up the substrate at a predetermined rate, and then dried.

However, depending on the properties of the oxidized layer spontaneously formed (naturally developed oxidized layer) before cleaning and on the cleaning conditions, the aluminum substrate often undergoes hydration reaction with hot pure water to cause non-uniform dissolution or formation of hydrate on its surface. If a photoconductive layer is formed on such an aluminum substrate, uneven coating occurs and the resulting electrophotographic photoreceptor is liable to drop and scattering of dark potential or drop of bright potential, resulting in defects in image such as black dots, white dots and unevenness.

It is said that a naturally developed oxidized layer on the surface of an aluminum substrate is normally stable to environmental change. However, the naturally developed oxidized layer is not stable enough in electrophotographic photoreceptors. In particular, it has been desired to enhance the stability of the naturally developed oxidized layer to moisture.

SUMMARY OF THE INVENTION

It is therefore an object of the present invention to provide an electrophotographic photoreceptor having less uneven coating and improved uniformity and stability of electrical properties and image properties and a process for its preparation.

The inventors made extensive studies to solve the foregoing problems. As a result, it was found that, in an electrophotographic photoreceptor comprising an electrically-conductive substrate made of aluminum or aluminum alloy and a photoconductive layer provided on the substrate and in a process for the preparation thereof, the contact of the surface of the electrically-conductive substrate with an aqueous solution containing at least phosphate ions provides the condition that the element ratio of aluminum in metallic form to aluminum in oxide form on the surface of the substrate is 1:1 to 1:2.5, preferably from 1:1.4 to 1:2.1 and that the element ratio of aluminum to phosphorus on the surface of the substrate is 1:0.02 to 1:0.1, preferably from 1:0.04 to 1:0.1, as determined by X-ray photoelectron spectroscopy, whereby the non-uniform modification of the surface of the electrically-conductive substrate due to drying from hot pure water or rinsing with water can be prevented and the resulting electrically-conductive substrate exhibits uniform and stable surface properties and improved electrical properties. Based on this finding, the present invention was accomplished.

The first embodiment of the present invention is an electrically-conductive substrate for electrophotographic photoreceptor comprising aluminum or aluminum alloy, wherein the element ratio of aluminum in metallic form to aluminum in oxide form on the surface of said substrate as determined by X-ray photoelectron spectroscopy is 1:1 to 1:2.5 and the element ratio of aluminum to phosphorus on the surface of said substrate as determined by X-ray photoelectron spectroscopy is 1:0.02 to 1:0.1.

The second embodiment of the present invention is an electrophotographic photoreceptor which comprises an electrically-conductive substrate for electrophotographic photoreceptor according to claim 1 and a photoconductive layer provided on said substrate.

The third embodiment of the present invention is a process for the preparation of an electrophotographic photoreceptor comprising an electrically-conductive substrate comprising aluminum or aluminum alloy and a photoconductive layer provided on said substrate, which comprises the steps of allowing said electrically-conductive substrate to contact with an aqueous solution comprising phosphate ions, and forming the photoconductive layer on the substrate.

DETAILED DESCRIPTION OF THE INVENTION

Figure 1:
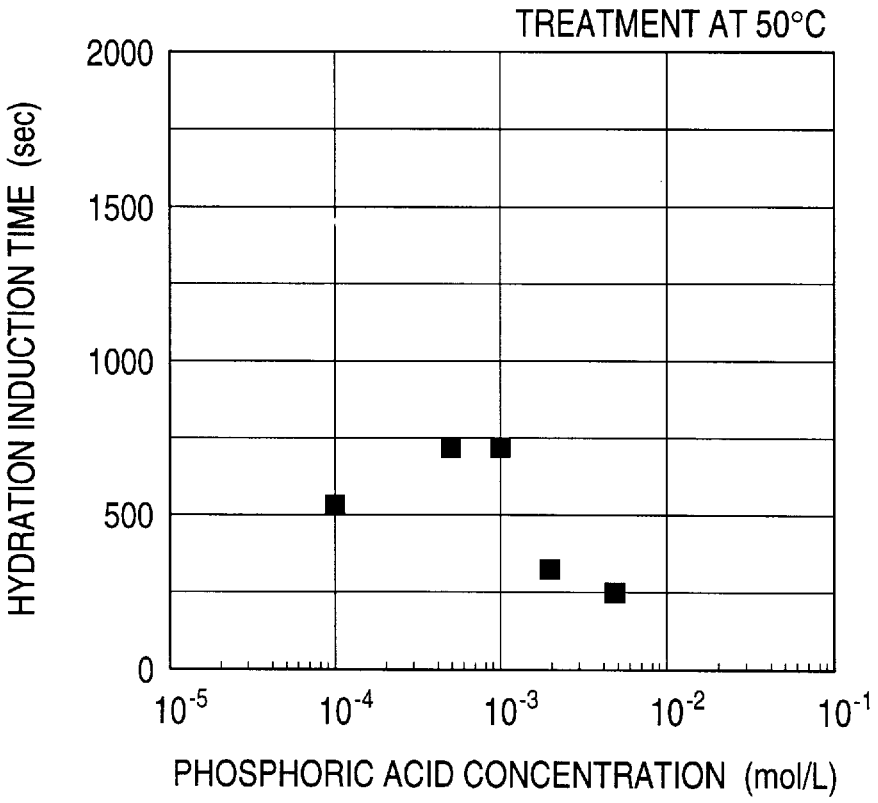
FIG. 1 illustrates the measurements of hydration induction time in the case of an aqueous phosphate solution at 50° C. in Example 1.
Figure 2:
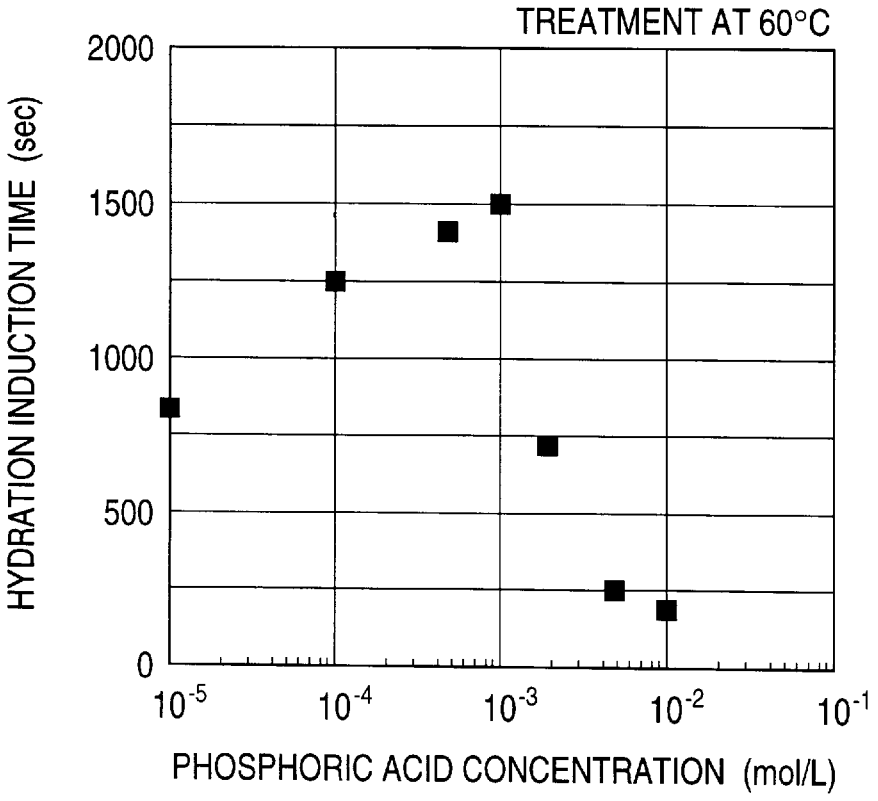
FIG. 2 illustrates the measurements of hydration induction time in the case of an aqueous phosphate solution at 60° C. in Example 1.
Figure 3:
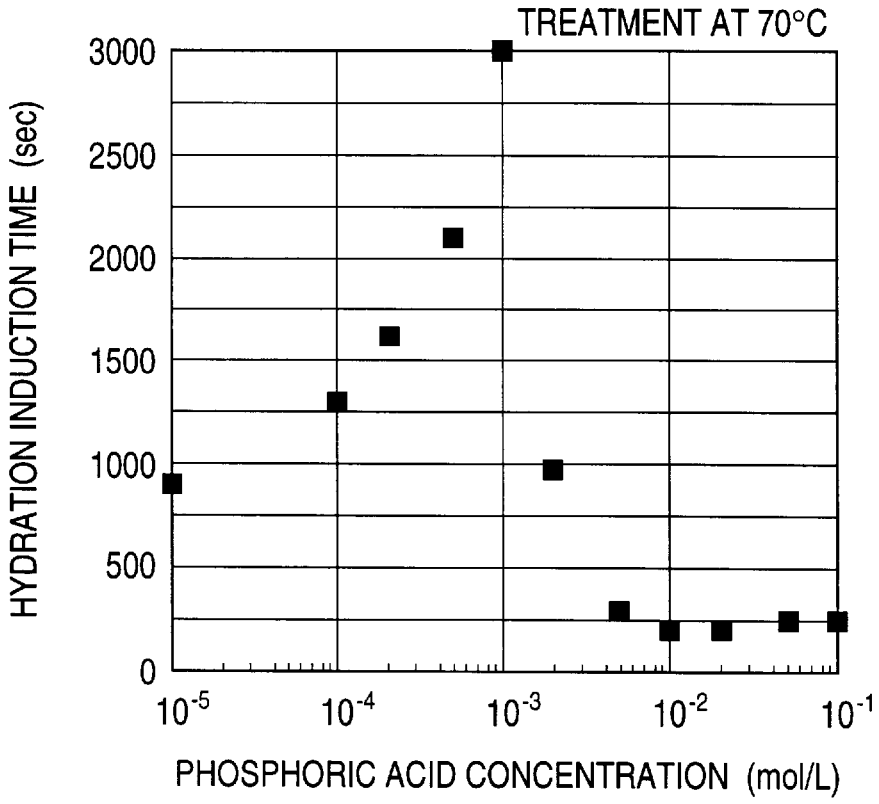
FIG. 3 illustrates the measurements of hydration induction time in the case of an aqueous phosphate solution at 70° C. in Example 1.
Figure 4:
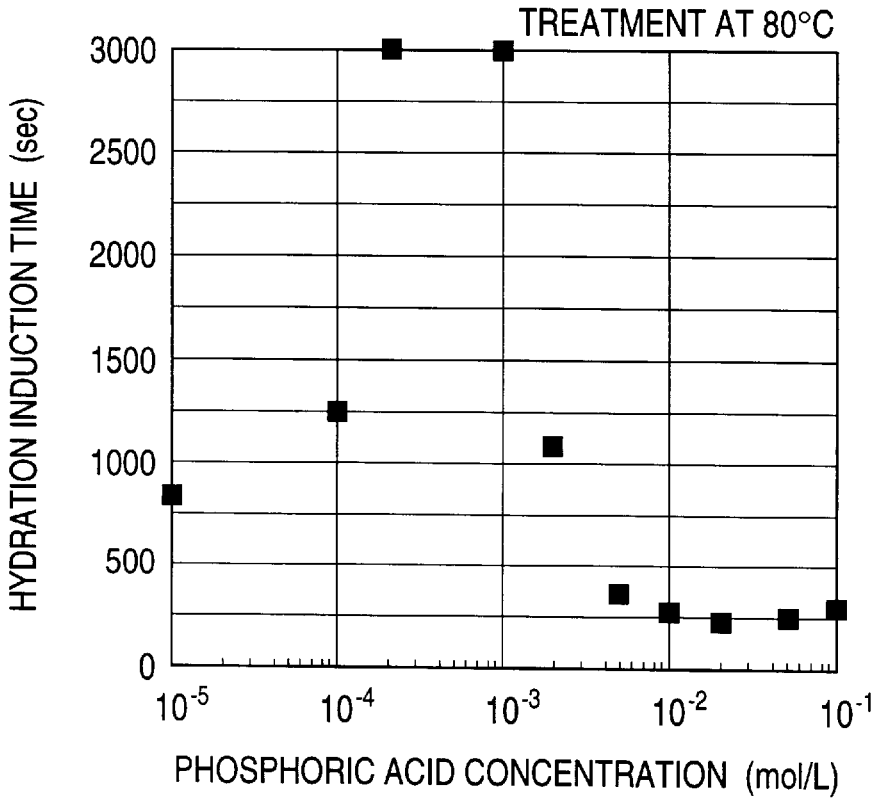
FIG. 4 illustrates the measurements of hydration induction time in the case of an aqueous phosphate solution at 80° C. in Example 1.

Hereinafter, the present invention will be further described in detail.

Aluminum and aluminum alloy may be used as the electrically-conductive substrate for electrophotographic photoreceptor. Examples of the material of the electrically-conductive aluminum substrate include pure aluminum according to JIS 1050, JIS 1070, JIS 1080, etc., and various aluminum alloys such as Al—Mn alloy, Al—Mg alloy, Al—Cu alloy, Al—Si alloy, Al—Mg—Si alloy, Al—Cu—Zn alloy, and the like. Preferred among these materials are an Al—Mn alloy according to JIS 3003, and an Al—Si—Mg alloy according to JIS 6063. The term "aluminum" as used herein is a general term which includes aluminum alloy, unless specifically expressed with distinguishing from aluminum alloy.

The process for the preparation of such an electrically-conductive aluminum substrate is not specifically limited. An aluminum billet may be processed by port-hole method, mandrel forming method or the like into an extruded tube which may then be subjected to pultrusion, impact molding, ironing or planishing by diamond turning to have a predetermined thickness and external diameter. Since the substrate has drawing oil, cutting oil, corrosion-preventing oil, various dust from the air, etc. attached to its surface, it is an ordinary practice to clean the surface of the substrate before the formation of the electrically-conductive layer. The production process according to the present invention is characterized in that the cleaned surface of the electrically-conductive substrate is contacted with an aqueous solution containing at least phosphate ions, normally followed by rinsing and drying.

The electrically-conductive aluminum substrate which has been thus processed is then cleaned. As the cleaning method, there may be used an ordinary method using a chlorine-based solvent, a fluorine-based solvent detergent, an organic solvent detergent (e.g., petroleum hydrocarbon), or a surfactant-based detergent. However, the cleaning method using an organic solvent detergent causes problems of environmental pollution and destruction of the ozone layer. Further, the organic solvent detergent is combustible. Moreover, the use of the surfactant-based detergent often causes problems in etching or corrosion. For the cleaning method, a detergent containing N-methyl-2-pyrrolidone and water as disclosed in JP-A-7-219244 or a detergent containing 1,2-butanediol and water as disclosed in JP-A-7-258605 is preferably used.

The aforementioned cleaning method is normally carried out in a cleaning tank. The cleaning tank is filled with a cleaning fluid which is normally kept at a predetermined temperature. The cleaning tank is equipped with an ultrasonic vibrator at its bottom or other portions so that the substrate can be cleaned with the aid of ultrasonic wave when dipped in the tank. The ultrasonic wave to be used is preferably that having multiple frequency or regularly varying frequency so that the ultrasonic wave can be applied to the surface of the substrate as uniformly as possible to prevent damages such as erosion. The substrate may be shaken or rotated during dipping, if necessary. The cleaning fluid is preferably circulated in such a manner that it is overflown at the top of the tank, which can prevent the electrically-conductive substrate from being re-stained when pulled up from the cleaning fluid.

The aforementioned cleaning treatment is usually carried out through several steps, and a step for mainly degreasing is usually included at a relatively early stage. The temperature of the degreasing fluid used in the degreasing step is normally predetermined to a range of from 30° C. to 95° C., preferably from 40° C. to 80° C. If the treatment temperature falls below 30° C., the resulting degreasing capacity is deteriorated. On the contrary, the treatment temperature exceeds 95° C. is not preferable since the evaporation loss of the cleaning fluid component is markedly raised and the control of the cleaning fluid component is difficult. The cleaning time is normally from 30 seconds to 30 minutes, preferably from 1 minute to 10 minutes. If the cleaning time is below 30 seconds, the removal of stain may be insufficient, often causing uneven cleaning. On the contrary, the cleaning time exceeds 30 minutes is not preferable since the throughput is reduced and the actual productivity is low.

The electrically-conductive aluminum substrate which has thus been cleaned with a degreasing fluid is then preferably rinsed in a rinsing tank to remove the attached cleaning fluid. This rinsing is carried out since the degreasing fluid, if remained, would interfere uniform treatment with the aqueous solution containing phosphate ions. In addition, this rinsing is to avoid pollution of the tank for the treatment with the aqueous solution containing phosphate ions. For the rinsing, tap water may be used. However, chlorine ion contained in tap water can corrode the electrically-conductive substrate. Thus, pure water or deionized water is preferably used. In general, the rinsing tank is filled with such water and kept almost at a predetermined temperature. The substrate is then dipped in the water for rinsing. At this time, the temperature is preferably controlled to not more than 50° C., more preferably from 30° C. to 40° C., so as to prevent hydration reaction. At a temperature lower than 20° C., there is a possibility of decreasing the cleaning effects. In order to carry out rinsing more effectively, the dip rinsing is preferably effected with the aid of ultrasonic wave. The ultrasonic wave to be used is preferably that having multiple frequency or regularly varying frequency so that the ultrasonic wave is applied to the surface of the substrate as uniformly as possible to prevent damages such as erosion. The substrate may be shaken or rotated during dipping, if necessary. When pulled up from the cleaning fluid, the substrate is preferably showered with the cleaning fluid to prevent re-staining.

In general, the electrically-conductive aluminum substrate which has thus been rinsed is then dried. In the present invention, the drying is preferably preceded by the contact of the electrically-conductive aluminum substrate with an aqueous solution containing at least phosphate ions such that the element ratio of aluminum in metallic form to aluminum in oxide form on the surface of the substrate is 1:1 to 1:2.5 (i.e., the ratio of the oxide form/the metallic form is from 1 to 2.5) and the element ratio of aluminum to phosphorus is 1:0.02 to 1:0.1 (i.e., the ratio of phosphorous/aluminum is from 0.02 to 0.1), as determined by X-ray photoelectron spectroscopy.

When the surface-planished substrate is used, the element ratio of aluminum in metallic form to aluminum in oxide form on the surface of the substrate is preferably 1:1 to 1:2.2. When the roughly planished substrate is used, the element ratio of aluminum in metallic form to aluminum in oxide form on the surface of the substrate is preferably 1:1.8 to 1 to 2.5. The term "roughly planished substrate" as used herein means a substrate having $R_{max}$ according to the JIS standard of 0.4 $\mu$m or more.

Examples of the compounds which generate phosphate ions used in the present invention include phosphoric acid (i.e., orthophosphoric acid), sodium dihydrogenphosphate, phosphorous acid, metaphosphoric acid, and pyrophosphoric acid, hypophosphorous acid, of which phosphoric acid (i.e., orthophosphoric acid) is the most preferable.

In the aqueous solution containing phosphate ions according to the present invention (referred also to as "aqueous phosphate solution" in this specification), the compound which generates phosphate ions is used in a concentration of normally not more than 0.1 mol/l, more preferably from 0.000001 mol/l to 0.01 mol/l, particularly from 0.0001 mol/l to 0.01 mol/l in order to easily control the aforementioned to element composition ratios to the predetermined ranges. If the concentration of the aqueous phosphate solution is too low, it gives a somewhat poor effect in suppressing hydration reaction with hot pure water. As a result, hydrates are non-uniformly produced on the surface of the substrate when the substrate comes in contact with hot pure water, making it difficult to obtain the desired electrophotographic photoreceptor properties. On the contrary, if the concentration of the aqueous phosphate solution is too high, the spontaneous oxide on the surface of the substrate or aluminum metal is etched during the treatment with the aqueous phosphate solution, making it difficult to obtain the desired electrophotographic photoreceptor properties.

Examples of the process for contacting the electrically-conductive aluminum substrate with the aqueous phosphate solution include dip method, and spray method. In general, the electrically-conductive aluminum substrate is dipped in the treatment tank to make uniform contact with the treatment. The treatment tank is filled with an aqueous phosphate solution which is kept at a predetermined temperature. This treatment removes oil content, dust, etc. remaining on the surface of the electrically-conductive aluminum substrate. Thus, the cleaning fluid is preferably circulated such that it is overflown at the top of the tank and that the oil content is separated or the cleaning fluid is filtered. The electrically-conductive aluminum substrate may be shaken or rotated during dipping, if necessary.

The temperature of the aqueous phosphate solution is preferably from 40° C. to 95° C., more preferably from 50° C. to 80° C. If the treatment temperature is too low, it gives a somewhat poor effect in suppressing hydration reaction with hot pure water. Thus, the reaction of the substrate with phosphoric acid proceeds slowly, requiring much treatment time. On the contrary, if the treatment temperature is too high, the reaction proceeds rapidly. However, the evaporation loss of the treating solution is remarkably raised, giving an adverse effect on the control of the treating solution component. Further, the surface of the aluminum substrate which has thus been treated can dry too fast, which makes the subsequent rinsing step difficult. As the method for preventing the drying of the surface of the substrate, it is possible to employ a process of spraying a cooled treating solution onto the surface of the substrate when the substrate is pulled up. However, this method is not preferably since it requires a complicated apparatus.

The time during which the substrate comes in contact with the aqueous phosphate solution is from 30 seconds to 30 minutes, preferably from 1 minute to 10 minutes. If the treatment time is too short, there is a high possibility that the adsorption of phosphorus by the surface of the substrate is non-uniform. On the contrary, if the treatment time is too long, the productivity is reduced, giving an adverse effect on the actual productivity.

The electrically-conductive aluminum substrate which has come in contact with the aqueous phosphate solution is then preferably rinsed in a rinsing tank to remove the attached treating solution. For the rinsing, tap water may be used. However, chlorine ion contained in tap water can be adsorbed by the electrically-conductive substrate. Thus, pure water or deionized water is preferably used. In general, the rinsing tank is filled with such water which is almost kept at a predetermined temperature. The substrate is dipped in the water for rinsing. In order to carry out rinsing more effectively, the dip rinsing is preferably effected with the aid of ultrasonic wave. The ultrasonic wave to be used is preferably that having multiple frequency or regularly varying frequency so that the ultrasonic wave is applied to the surface of the substrate as uniformly as possible to prevent damages such as erosion. For the purpose of preventing re-staining with the used rinsing solution, the substrate is preferably showered with water when the substrate is pulling up from the rinsing solution. Alternatively, the rinsing solution is preferably discharged in such an arrangement that it is overflown at the top of the tank.

The electrically-conductive aluminum substrate which has thus been rinsed is then dried. For the drying, the substrate may be pulled up from hot pure water. Alternatively, hot air drying, infrared drying and drying by induction heating may be effected singly or in combination. Any method may be used so far as it can uniformly remove moisture from the surface of the substrate. In general, hot air drying is carried out after pulling up the substrate from hot pure water from the standpoint of uniformity in dried surface or simplicity of apparatus.

Referring to the drying during the pulling up of the substrate, the electrically-conductive aluminum substrate may be dipped in the tank filled with pure water or deionized water which has been heated by a heater to a predetermined temperature, and then pulled up from the tank at a predetermined rate and dried. In general, pure water or deionized water is introduced into the tank from the bottom of the tank and then overflown at the top of the tank to keep the uniform temperature distribution in the tank or cleanness. When the substrate is pulled up from the tank, the overflow at the top of the tank is preferably suspended to minimize the disturbance of water surface for the purpose of keeping the uniformity in water film on the surface of the substrate which has been pulled up. If necessary, evacuation may be effected to remove water vapor over the water surface.

Hot air drying is effected by means of a hot air dryer. The air taken from the exterior is introduced into a heater chamber where it is then heated by an electric or vapor heater, which is then passed into the tank by an air fan. During this procedure, the air may be passed through a heat-resistant hepafilter to remove from the hot air dust which would be attached to the surface of the substrate. The tank temperature is controlled by a temperature detector and a controller provided on the passage of hot air. When the surface of the electrically-conductive aluminum substrate is non-uniformly heated by uneven stream of hot air, the aluminum oxide layer on the surface of the substrate would be non-uniformly modified. Thus, it is desired to arrange such that hot air is applied to the surface of the substrate as uniformly as possible.

A photoconductive layer is provided on the electrically-conductive substrate which has thus been cleaned. An inorganic or organic photoconductive layer is used as the photoconductive layer. In particular, a laminated photoconductive layer having a charge-generating layer and a charge-transferring layer is useful. The photoconductive layer such as charge-generating layer and charge-transferring layer may be formed on the surface of the substrate by dipping the substrate in a coating solution containing the substances constituting the layer or spraying the coating solution onto the substrate.

Referring to the laminated photoconductive layer, examples of the charge-generating substance constituting the charge-generating layer include an inorganic photoconductive material such as selenium, selenium alloy, arsenic-selenium, cadmium sulfate and zinc oxide or an organic pigment such as phthalocyanine, azo, quinacrydone, polycyclic quinone, perylene, indigo and benzimidazole. Particularly preferred examples of these charge-generating substances include metal or metal compound such as copper, indium chloride, potassium chloride, tin, oxytitanium, zinc and vanadium, oxides thereof, phthalocyanines having coordinated chlorine, metal-free phthalocyanine, and azo pigments such as monoazo, bisazo, trisazo and polyazo pigments.

The charge-generating layer may be formed in the form of uniform layer having such a substance or a layer having fine dispersion of such a substance in a binder. Examples of the binder resin include polyvinyl butyral, phenoxy resin, epoxy resin, polyester resin, acrylic resin, methacrylic resin, polyvinyl acetate, polyvinyl chloride, methyl cellulose, and polycarbonate resin.

The foregoing charge-generating substance is preferably incorporated in an amount of from 20 to 300 parts by weight, particularly from 30 to 150 parts by weight based on 100 parts by weight of the binder resin used. The thickness of the charge-generating layer is normally not more than 5 $\mu$m, preferably from 0.01 to 1 $\mu$m.

As the charge-transferring substance to be incorporated in the charge-transferring layer, there may be used a high molecular compound such as polyvinyl carbazole, polyvinyl pyrene and polyacenaphthylene or a low molecular compound such as pyrazoline derivative, oxazole derivative, hydrazone derivative and stilbene derivative. Preferred among these charge-transferring substances are low molecular compounds. A binder resin may be incorporated with such a charge-transferring substance, if necessary. Preferred examples of the binder resin to be used include vinyl polymer such as polymethyl methacrylate, polystyrene and polyvinyl chloride, copolymer thereof, polycarbonate, polyester, polysulfone, phenoxy resin, epoxy resin, and silicone resin. Alternatively, partly-crosslinked hardened products of these binder resins may be used.

The foregoing charge-transferring substance is preferably incorporated in an amount of from 30 to 200 parts by weight, particularly from 50 to 150 parts by weight based on 100 parts by weight of the binder resin used. The charge-transferring layer may contain various additives such as anti-oxidant and sensitizer, if necessary. The thickness of the charge-transferring layer is normally from 10 to 40 $\mu$m, preferably from 10 to 35 $\mu$m.

Another example of the photoconductive layer is a laminated photoconductive layer having the foregoing particulate charge-generating substance dispersed in a binder comprising a binder resin and the foregoing charge-transferring substance. In this case, the sum of the amounts of the charge-generating substance and the charge-transferring substance is preferably from 20 to 200 parts by weight, particularly from 40 to 150 parts by weight based on 100 parts by weight of the binder resin used.

The present invention will be further described in the following examples and comparative examples, but the present invention should not be construed as being limited thereto. The term "parts" as used hereinafter is meant to indicate "parts by weight".

EXAMPLE 1

A surface-planished aluminum substrate (port-hole tube according to JIS6063; thickness: 1 mm; surface roughness after planishing (maximum height, $R_{max}$): 0.3 s or less (JIS, B0601 (1982), JIS, B0031 (1982)) was subjected to ultrasonic cleaning, cold bath cleaning and vapor cleaning with trichloroethylene to obtain an aluminum substrate to be evaluated. Phosphoric acid was added to pure water to prepare a 0.0001 mol/l aqueous phosphate solution which was then heated to a temperature of 50° C. The aluminum substrate was dipped in the aqueous phosphate solution for 1 minute, and then rinsed with pure water. The aluminum substrate which had been thus treated with an aqueous phosphate solution was then dipped in pure water which had been heated to a temperature of 80° C. The time required until hydrogen foam is generated from the surface of the aluminum substrate was measured as the induction time required until hydration-oxidation reaction begins (hereinafter referred to as "hydration induction time"). The same procedure as described above was followed except that the concentration of phosphoric acid was changed from 0.00001 to 0.1 mol/l and the temperature of treatment with an aqueous phosphate solution was changed to 60° C., 70° C., and 80° C. Thus, the hydration reaction induction time was measured. The maximum time allowable for the measurement of hydration induction time was 3,000 seconds.

The measurements of hydration induction time at solution temperatures of 50° C., 60° C., 70° C. and 80° C. are set forth in FIGS. 1 to 4. These results show that the contact with an aqueous phosphate solution containing phosphate ions in an amount of not more than 0.01 mol/l provides a prolonged hydration induction time that gives a remarkable hydration-oxidation resistance to hot pure water (corrosion resistance).

COMPARATIVE EXAMPLE 1

The same aluminum substrate as used in Example 1 was used but without treating with phosphoric acid. The aluminum substrate was then dipped in pure water which had been heated to a temperature of 80° C. in the same manner as in Example 1. In this manner, hydration induction time until hydrogen foam is generated from the surface of the aluminum substrate was measured. As a result, the hydration induction time was 130 seconds.

EXAMPLE 2

The same procedure as described in Example 1 was followed except that pyrophosphoric acid was used at a concentration of $5\times10^{-5}$ mol/l, $1\times10^{-4}$ mol/l, or $5\times10^{-4}$ mol/l at 80° C. and that dipping was carried out for 1 to 3 minutes. The aluminum substrate which had been thus treated with an aqueous pyrophosphate solution was then dipped in pure water which had been heated to a temperature of 80° C., and the hydrate induction time was measured. The results are shown in the Table 1 below.

TABLE 1

| Concentration of Pyrophosphate (mol/l) | Dipping Time in Aqueous Pyrophosphate Solution (minute) | Hydration Induction Time (minute) |
|---|---|---|
| $5 \times 10^{-5}$ | 1 | 12.5 |
| | 3 | 13 |
| $1 \times 10^{-4}$ | 1 | 18.75 |
| | 3 | 12.5 |
| $5 \times 10^{-4}$ | 1 | 6.25 |
| | 3 | 4 |

EXAMPLE 3

The same procedure as described in Example 1 was followed except that sodium dihydrogenphosphate was used at a concentration of $5\times10^{-5}$ mol/l, $1\times10^{-4}$ mol/l, or $1\times10^{-3}$ mol/l at 80° C. and that dipping was carried out for 1 to 3 minutes. The aluminum substrate which had been thus treated with an aqueous sodium dihydrogenphosphate solution was then dipped in pure water which had been heated to a temperature of 80° C., and the hydrate induction time was measured. The results are shown in the Table 2 below.

TABLE 2

| Concentration of Sodium Dihydrogen-phosphate (mol/l) | Dipping Time in Aqueous Sodium Dihydrogen-phosphate Solution (minute) | Hydration Induction Time (minute) |
|---|---|---|
| $5 \times 10^{-5}$ | 1 | 12 |
| | 3 | 25.5 |
| $1 \times 10^{-4}$ | 1 | 17 |
| | 3 | 26 |
| $1 \times 10^{-3}$ | 1 | 13 |
| | 3 | 24.5 |

EXAMPLE 4

A surface-planished aluminum substrate (port-hole tube according to JIS6063; thickness: 1 mm) was subjected to ultrasonic cleaning, cold bath cleaning and vapor cleaning with trichloroethylene in the same manner as in Example 1 to obtain an aluminum substrate to be evaluated. Phosphoric acid was added to pure water to prepare 0.00001 mol/l, 0.0001 mol/l, 0.001 mol/l and 0.01 mol/l phosphate aqueous solutions which were then heated to a temperature of 80° C. The aluminum substrate was then dipped in each of these aqueous phosphate solutions for 1 minute or 10 minutes, rinsed with pure water, and then spontaneously dried.

The specimens which had thus been treated were each measured for the element ratio of aluminum in oxide form to aluminum in metallic form on its surface and the element ratio of aluminum to phosphorus as determined by X-ray photoelectron spectroscopy on its surface, by means of SHIMADZU/KRATOS XSAM800pci. The measurement was carried out under the conditions of X-ray source of $MgK_{\alpha}$(14 kV and 20 mA), pass energy of 20 eV and scanning step of 0.1 eV.

Figure 5:
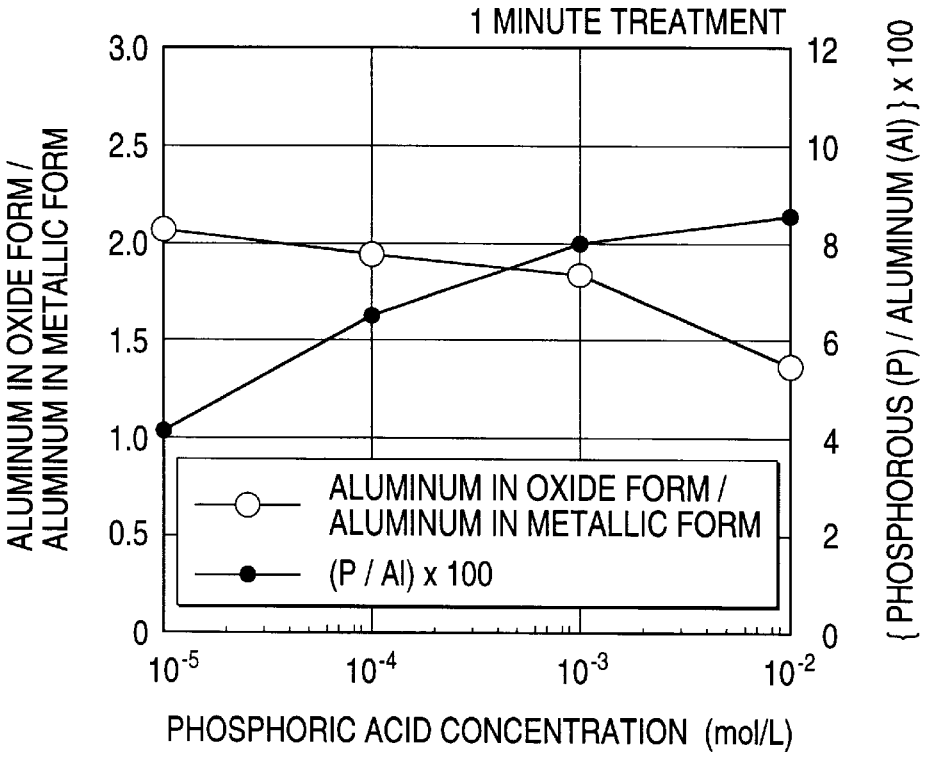
FIG. 5 illustrates the measurements of element composition ratio in the case of the treatment with an aqueous phosphate solution for 1 minute in Example 4.
Figure 6:
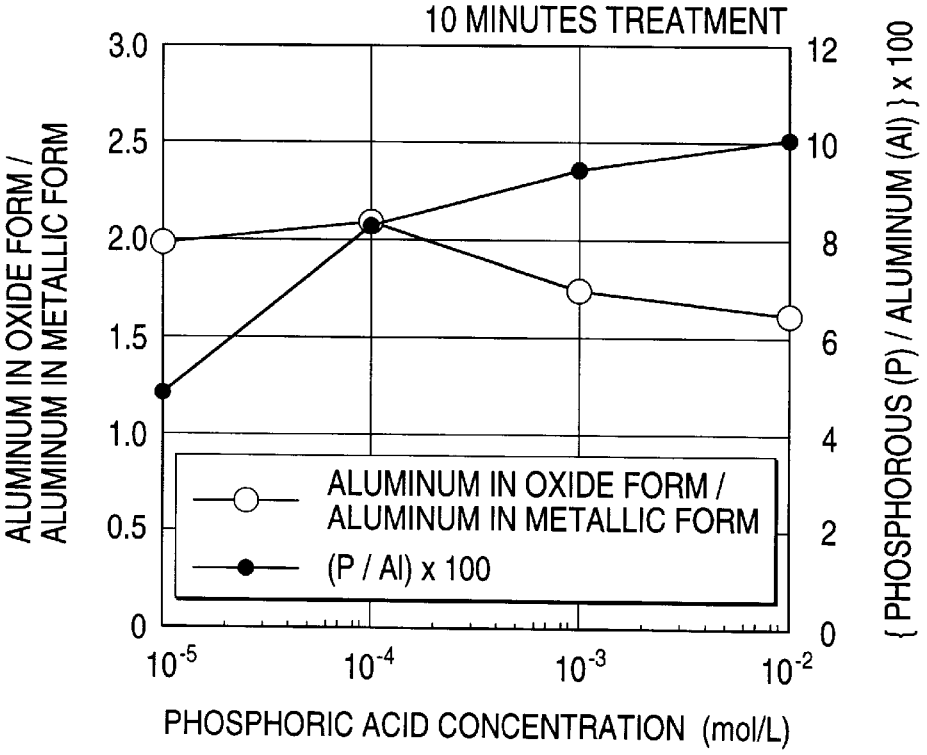
FIG. 6 illustrates the measurements of element composition ratio in the case of the treatment with an aqueous phosphate solution for 10 minutes in Example 4.

The measurement results of the sample of Example 4 for the ratio of aluminum in oxide form to aluminum in metallic form on the aluminum surface (referred to as "aluminum oxide/aluminum metal" in the drawings below) and the element ratio of aluminum to phosphorus on the aluminum surface are shown in FIG. 5 (1 minute of dipping in an aqueous phosphate solution) and FIG. 6 (10 minutes of dipping in an aqueous phosphate solution). These figures show that the surface of an aluminum substrate which has been treated in such a manner that a remarkable hydration-oxidation resistance (corrosion resistance) to hot pure water can be obtained has a constitution such that the element ratio of aluminum in metallic form to aluminum in oxide form on the surface is 1:1.4 to 1:2.1 and the element ratio of aluminum to phosphorus is 1:0.04 to 1:0.1. The treatment temperature was changed to 50° C., 60° C. and 70° C. and the same measurements as described above were carried out. As a result, the element ratio of aluminum in metallic form to aluminum in oxide form on the surface and the element ratio of aluminum to phosphorus on the surface fell within the foregoing ranges.

EXAMPLE 5

A 1 mm thick surface-planished cylindrical aluminum substrate was degreased in a cleaning fluid containing 85% by weight of 1,2-butanediol and 15% by weight of pure water which had been heated to a temperature of 65° C. while being vibrated by a frequency modulation-type ultrasonic oscillator (basic frequency: 39 kHz) for 5 minutes.

Subsequently, the aluminum substrate was allowed to stand at the top of the cleaning tank to drop the cleaning fluid. The aluminum substrate was then rinsed in deionized water at ordinary temperature while being vibrated by a frequency modulation-type ultrasonic oscillator (basic frequency: 39 kHz) for 30 seconds. The aluminum substrate was then brush-cleaned while spraying deionized water. Subsequently, the aluminum substrate was dipped in an aqueous phosphate solution. This contact treatment was carried out under the following five conditions:

(A) Phosphoric acid content: 0.0020 mol/l; temperature: 80° C.; time: 1 minute (B) Phosphoric acid content: 0.0010 mol/l; temperature: 80° C.; time: 1 minute (C) Phosphoric acid content: 0.0010 mol/l; temperature: 70° C.; time: 1 minute (D) Phosphoric acid content: 0.0002 mol/l; temperature: 50° C.; time: 10 minutes (E) Phosphoric acid content: 0.0001 mol/l; temperature: 80° C.; time: 1 minute Thereafter, the aluminum substrate was rinsed in deionized water (electrical conductance: 1 μS/cm) at ordinary temperature for 1 minute. When pulled up from the rinsing tank, the surface of the aluminum substrate was spray-rinsed with deionized water under the application of ultrasonic wave.

Subsequently, the rinsed aluminum substrate was dipped for 5 seconds in a drying tank in which 80° C. deionized water is supplied from the bottom and overflowed at the top. The aluminum substrate was then pulled up at a rate of 10 mm/sec. Thereafter, the aluminum substrate was heated and dried at 120° C. in a clean oven for 1 minute to obtain an electrically-conductive substrate for electrophotographic photoreceptor.

To 1 part of a bisazo compound represented by the following general formula [I] as a charge-generating substance were added 20 parts of dimethoxyethane. The mixture was then subjected to dispersion by means of a sandgrinder. The dispersion thus obtained was then added to a solution of 0.5 parts of a polyvinyl acetal resin (Denka Butyral #6000C, available from Denki Kagaku Kogyo K.K.) in 10 parts of dimethoxyethane to obtain a dispersion for charge-generating layer.

[I]

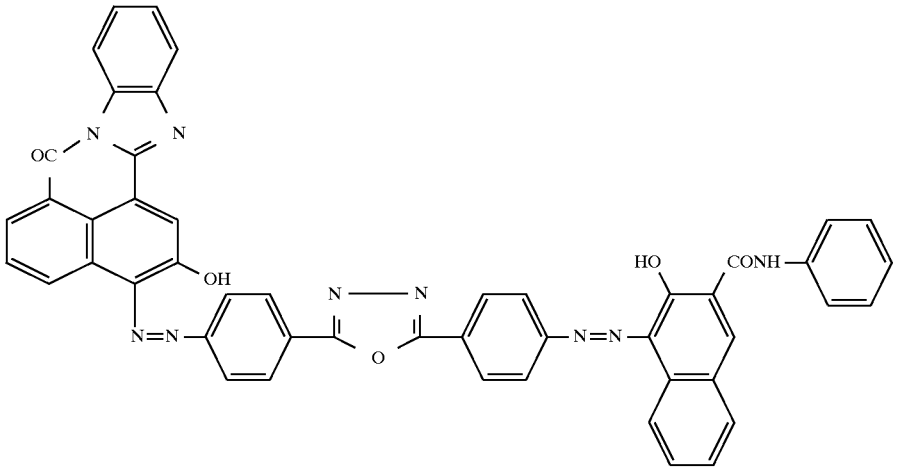

The foregoing electrically-conductive substrate for electrophotographic photoreceptor which had been treated with phosphoric acid was dipped in the dispersion for charge-generating layer to form a charge-generating layer having a dry thickness of 0.63 μm.

On the other hand, 110 parts of a hydrazone compound represented by the following general formula [II] as a charge-transferring material, 100 parts of a polycarbonate resin (viscosity-average molecular weight: approx. 22,000) having a repeating unit represented by the following general formula [III], and 8 parts of a phenol compound were dissolved in 500 parts of tetrahydrofuran.

[II]

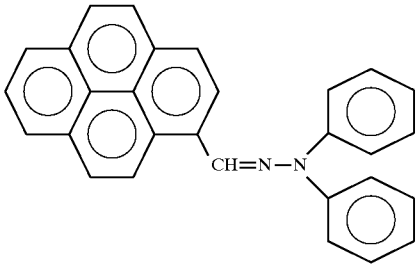

[III]

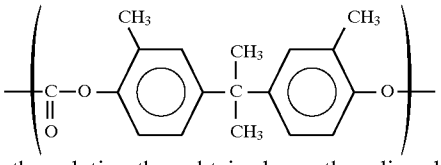

In the solution thus obtained was then dipped the foregoing electrically-conductive substrate for electrophotographic photoreceptor having a charge-generating layer formed thereon so as to form a charge-transferring layer having a thickness of 21 μm when dried at 125° C. for 20 minutes. Thus, an electrophotographic photoreceptor was obtained.

COMPARATIVE EXAMPLE 2

The same 1 mm thick planished cylindrical aluminum substrate as used in Example 5 was cleaned by means of a trichloroethylene cleaning machine. The aluminum substrate was dipped in trichloroethylene at 40° C. in the first tank while being shaken for 4 minutes with ultrasonic treatment. The aluminum substrate was moved to the second tank where it was then subjected to the same treatment as in the first tank. The aluminum substrate was then cleaned by dipping in trichloroethylene at 30° C. in the third tank for 3 minutes. Finally, the aluminum substrate was allowed to stand in trichloroethylene vapor at 87° C. in the fourth tank for 3 minutes. Thereafter, a photosensitive layer was formed on the aluminum substrate in the same manner as in Example 5 to prepare an electrophotographic photoreceptor.

Evaluation 1

Four samples each for the electrophotographic photoreceptors (A) to (E) obtained in Example 5 and two samples for the electrophotographic photoreceptor obtained in Comparative Example 2 were charged to −600 V by a scorotron charger in a 25° C.–50% RH dark place. These samples were then measured for surface potential when exposed to white light of 1.13 lux·sec. and 2.43 lux·sec. The results are set forth in Table 3.

TABLE 3

| Treatment conditions | Surface potential (−V) Exposed to 1.13 lux · sec. | Exposed to 2.43 lux · sec. |
|---|---|---|
| (A) of Example 5 | 301, 296, 297, 295 | 69, 65, 65, 63 |
| (B) of Example 5 | 288, 283, 294, 288 | 59, 53, 63, 55 |
| (C) of Example 5 | 291, 292, 295, 297 | 60, 62, 64, 67 |
| (D) of Example 5 | 281, 295, 289, 296 | 52, 66, 59, 66 |
| (E) of Example 5 | 284, 290, 293, 291 | 51, 56, 60, 60 |
| Comparative Example 2 | 301, 297 | 71, 69 |

Table 3 shows that the use of electrophotographic photoreceptors which have been treated by the contact with an aqueous phosphate solution according to the present invention provide a low surface potential under the same exposure conditions (particularly 2.43 lux·sec.) as compared with Comparative Example 2 and thus exhibit an enhanced sensitivity.

Evaluation 2

The electrophotographic photoreceptors prepared in Example 5 and Comparative Example 2 were each mounted on a commercially available copying machine. Under these conditions, image was then evaluated on white solid, black solid and halftone background. As a result, there was no difference in image evaluation between Example 5 and Comparative Example 2, demonstrating that the electrophotographic photoreceptors according to the present invention provide good image properties.

EXAMPLE 6

A 0.75 mm thick surface-planished cylindrical aluminum substrate was degreased in a cleaning fluid containing 85% by weight of N-methyl-2-pyrrolidone and 15% by weight of pure water which had been heated to a temperature of 60° C. while being vibrated by a frequency modulation-type ultrasonic oscillator (basic frequency: 39 kHz) for 5 minutes.

Subsequently, the aluminum substrate was allowed to stand at the top of the cleaning tank to drop the cleaning fluid. The aluminum substrate was then rinsed in deionized water at ordinary temperature while being vibrated by a frequency modulation-type ultrasonic oscillator (basic frequency: 39 kHz) for 30 seconds. The aluminum substrate was then brush-cleaned while spraying deionized water. Subsequently, the aluminum substrate was dipped in an aqueous phosphate solution. This contact treatment was carried out under the following two conditions:

(F) Phosphoric acid content: $1\times10^{-4}$ mol/l; temperature: 70° C.; time: 3 minute (G) Phosphoric acid content: $2\times10^{-4}$ mol/l; temperature: 70° C.; time: 3 minute Thereafter, the aluminum substrate was rinsed in deionized water (electrical conductance: 1 μS/cm) at ordinary temperature for 1 minute. When pulled up from the rinsing tank, the surface of the aluminum substrate was spray-rinsed with deionized water under the application of ultrasonic wave.

Subsequently, the rinsed aluminum substrate was dipped for 5 seconds in a drying tank in which 80° C. deionized water is supplied from the bottom and overflowed at the top. The aluminum substrate was then pulled up at a rate of 10 mm/sec. Thereafter, the aluminum substrate was heated and dried at 120° C. in a clean oven for 1 minute to obtain an electrically-conductive substrate for electrophotographic photoreceptor.

Thereafter, the CGL Coating Solution A shown below was applied to the substrate to form a charge-generating layer having a dry weight of 0.4 g/m$^2$.

On the charge-generating layer thus formed, the CTL Coating Solution A was applied to form a charge-transferring layer having a thickness of 17 μm. Thus, an electrophotographic photoreceptor was obtained.

CGL Coating Solution A

To 10 parts of oxytitanium phthalocyanine were added 2.5 parts of polyvinyl butyral (Denka Butyral #6000-C, produced by Denki Kagaku Kogyo K.K.), 2.5 parts of a phenoxy resin (PKHH, produced by Union Carbide Corporation), and 500 parts of 1,2-dimethoxyethane. The mixture was subjected to pulverizing and dispersing treatment with the use of a sandgrind mill to prepare a CGL coating solution A.

CTL Coating Solution A

In 100 parts of 1,4-dioxane, 56 parts of the hydrazone compound shown below:

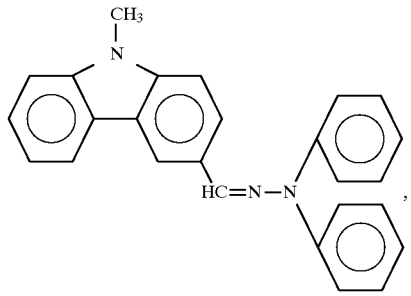

14 parts of a hydrazone compound shown below:

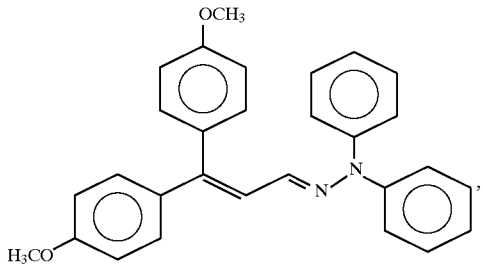

and 100 parts of a polycarbonate resin having the repeating unit shown below:

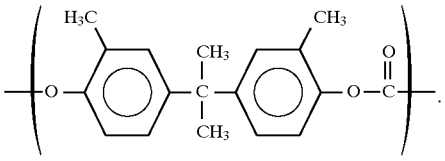

were dissolved to prepare CTL Coating Solution A.

COMPARATIVE EXAMPLE 3

The same 1 mm thick planished cylindrical aluminum substrate as used in Example 6 was cleaned by means of a trichloroethylene cleaning machine. The aluminum substrate was dipped in trichloroethylene at 40° C. in the first tank while being shaken for 4 minutes with ultrasonic treatment. The aluminum substrate was moved to the second tank where it was then subjected to the same treatment as in the first tank. The aluminum substrate was then cleaned by dipping in trichloroethylene at 30° C. in the third tank for 3 minutes. Finally, the aluminum substrate was allowed to stand in trichloroethylene vapor at 87° C. in the fourth tank for 3 minutes. Thereafter, a photosensitive layer was formed on the aluminum substrate in the same manner as in Example 6 to prepare an electrophotographic photoreceptor.

Evaluation 3

Two samples each for the electrophotographic photoreceptors (F) and (G) obtained in Example 6 and two samples for the electrophotographic photoreceptor obtained in Comparative Example 3 were charged to −600 V by a scorotron charger in a 25° C.–50% RH dark place. These samples were then measured for surface potential ($V_L$) when exposed to 2.5 $\mu$J/cm$^2$ of 780 nm monochromatic light obtained from a halogen lamp light through a band-pass filter.

The electrophotographic photoreceptor was rotated at a constant rate (36 mm/sec) in a dark place and was charged to a constant voltage (−600 V) by a scorotron charger. Then, the photoreceptor was exposed to 780 nm monochromatic light obtained from a halogen lamp light through a band-pass filter, and the amount of exposure required for reducing the surface potential of the photoreceptor to half of the initial charged potential was measured as $E_{1/2}$. The results are set forth in Table 4.

TABLE 4

| Treatment conditions | $E_{1/2}$ ($\mu$J/cm$^2$) | | $V_L$ (−V) | |
|---|---|---|---|---|
| (F) of Example 6 | 0.542 | 0.552 | 64 | 63 |
| (G) of Example 6 | 0.541 | 0.548 | 66 | 65 |
| Comparative Example 3 | 0.588 | 0.580 | 82 | 80 |

EXAMPLE 7

Figure 7:
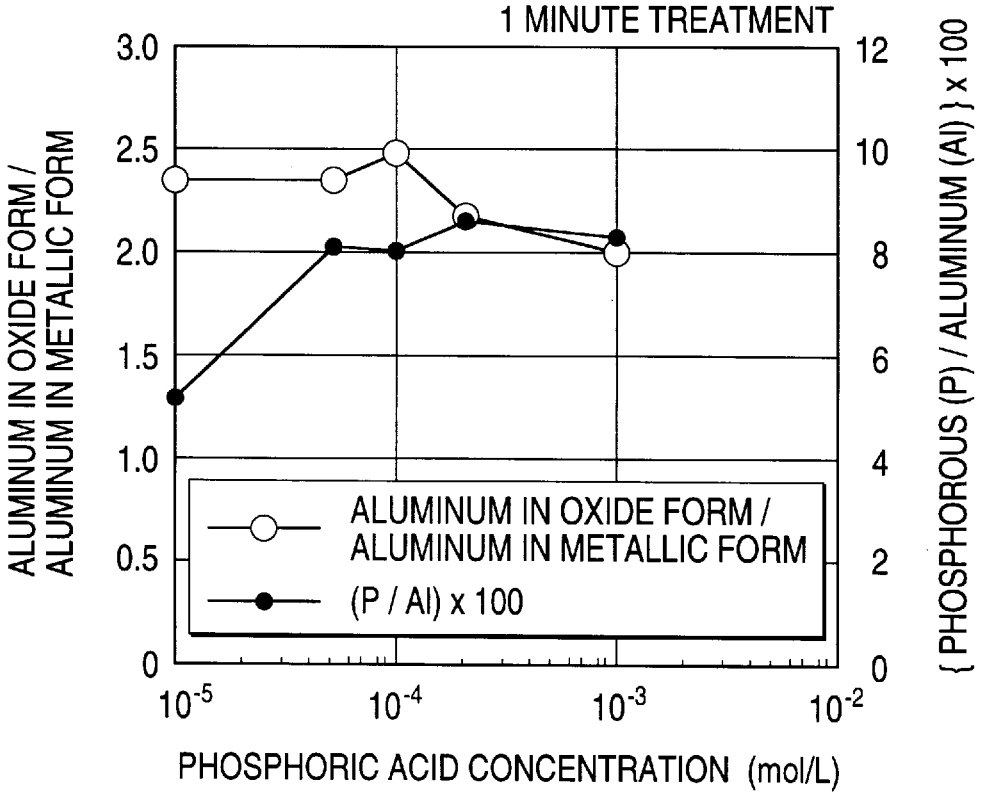
FIG. 7 illustrates the measurements of element composition ratio in the case of the treatment of a CP tube with an aqueous phosphate solution for 1 minute in Example 7.

The procedure as described in Example 4 was followed except that the phosphoric acid concentration was changed to $1\times10^{-5}$ mol/l, $5\times10^{-5}$ mol/l, $1\times10^{-4}$ mol/l, $2\times10^{-4}$ mol/l, $1\times10^{-3}$ mol/l and that a surface-planished aluminum substrate (port-hole tube according to JIS6063; thickness: 1 mm; surface roughness after planishing (maximum height, $R_{max}$): about 0.8 s (JIS B0601 (1982), JIS B0031 (1982))) was used. The results are shown in FIG. 7.

In accordance with the present invention, the deterioration of electrophotographic photoreceptor properties due to non-uniform dissolution of the surface of an aluminum substrate or production of hydrates during rinsing or drying from hot pure water in an aqueous cleaning process can be prevented, assuring the uniformity and stability on the surface of an electrically-conductive substrate for electrophotographic photoreceptor. At the same time, the resulting electrically-conductive substrate for electrophotographic photoreceptor exhibits an excellent corrosion resistance that can be expected to provide a high environmental stability. Further, the resulting electrophotographic photoreceptor can exhibit improved electrical properties.

While the invention has been described in detail and with reference to specific embodiments thereof, it will be apparent to one skilled in the art that various changes and modifications can be made therein without departing from the spirit and scope thereof.

This application is based on Japanese patent application 8-86445, filed on Apr. 9, 1996, incorporated herein by reference.

What is claimed is:

1. An electrically-conductive substrate for electrophotographic photoreceptor comprising aluminum or aluminum alloy, wherein the element ratio of aluminum in metallic form to aluminum in oxide form on the surface of said substrate as determined by X-ray photoelectron spectroscopy is 1:1 to 1:2.5 and the element ratio of aluminum to phosphorus on the surface of said substrate as determined by X-ray photoelectron spectroscopy is 1:0.02 to 1:0.1.

2. The electrophotographic photoreceptor which comprises an electrically-conductive substrate for electrophotographic photoreceptor according to claim 1 and a photoconductive layer provided on said substrate.

3. A process for the preparation of an electrophotographic photoreceptor comprising an electrically-conductive substrate comprising aluminum or aluminum alloy and a photoconductive layer provided on said substrate, which comprises the steps of:

allowing said electrically-conductive substrate to contact with an aqueous solution comprising phosphate ions, wherein the content of said phosphate ions in said aqueous solution is not more than 0.01 mol/l, and forming the photoconductive layer on the substrate.

4. The process for the preparation of an electrophotographic photoreceptor according to claim 3, wherein said phosphate ions are derived from phosphoric acid.

5. The process for the preparation of an electrophotographic photoreceptor according to claim 3, which further comprises a step of cleaning the substrate with a solution comprising 1,2-butanediol and water before the step of allowing said substrate to contact with an aqueous solution comprising phosphate ions.

6. The process for the preparation of an electrophotographic photoreceptor according to claim 3, which further comprises a step of cleaning the substrate with a solution comprising N-methyl-2-pyrrolidone and water before the step of allowing said substrate to contact with an aqueous solution comprising phosphate ions.

* * * * *